United States Patent [19]

Yee et al.

[11] Patent Number: 4,618,840

[45] Date of Patent: Oct. 21, 1986

[54] AIR-LINE MICROWAVE COAXIAL REVERSING SWITCH HAVING DIAGONALLY SWITCHED PATH

[75] Inventors: Harold H. Yee, Rancho Palos Verdes; James F. Hudson, Manhattan Beach, both of Calif.

[73] Assignee: Hughes Aircraft Company, Los Angeles, Calif.

[21] Appl. No.: 598,102

[22] Filed: Apr. 9, 1984

[51] Int. Cl.[4] ..... H01P 1/10

[52] U.S. Cl. ..... 333/105; 333/108; 200/153 S; 335/5

[58] Field of Search ..... 333/105, 108, 107, 262; 200/153 S; 335/4, 5

[56] References Cited

U.S. PATENT DOCUMENTS

| | | | |
|---|---|---|---|
| 2,858,382 | 10/1958 | Lehman | 200/153 S X |
| 2,958,053 | 10/1960 | Concelman | 333/105 |
| 3,414,849 | 12/1968 | Burt, Jr. | 333/105 |
| 3,739,306 | 6/1973 | Sladek | 333/105 |
| 4,070,637 | 1/1978 | Assal et al. | 333/105 |
| 4,317,972 | 3/1982 | Kjellberg | 200/153 S |
| 4,330,766 | 5/1982 | Pentlicki | 333/105 |

*Primary Examiner*—Eugene R. Laroche
*Assistant Examiner*—Benny T. Lee
*Attorney, Agent, or Firm*—J. A. Sawyer, Jr.; M. J. Meltzer; A. W. Karambelas

[57] ABSTRACT

A switch (10) of the type comprising a rectangular arrangement of ports (21, 22, 23 and 24) includes a diagonally extending connector bar (35) disposed on one side of the rectangular arrangement opposite four laterally extending connector bars (31, 32, 33 and 34). The diagonally disposed connector bar is actuatable independently of the other bars. Electromagnetically driven rockers (79) or other means are provided to actuate the rods. In one realization of the switch, the ports are coaxial connectors for a microwave network. Each connector bar resides within a corresponding groove (51, 61) in a conductive housing and is independently actuatable. When actuated, a bar contacts the center conductors of two ports. The actuated bar cooperates with the walls of the containing groove to form an air-line microwave connection between the contacted ports. When the contained bar is unactuated, the groove becomes a waveguide-beyond-cutoff to isolate the respective ports.

10 Claims, 4 Drawing Figures

Fig. 3.
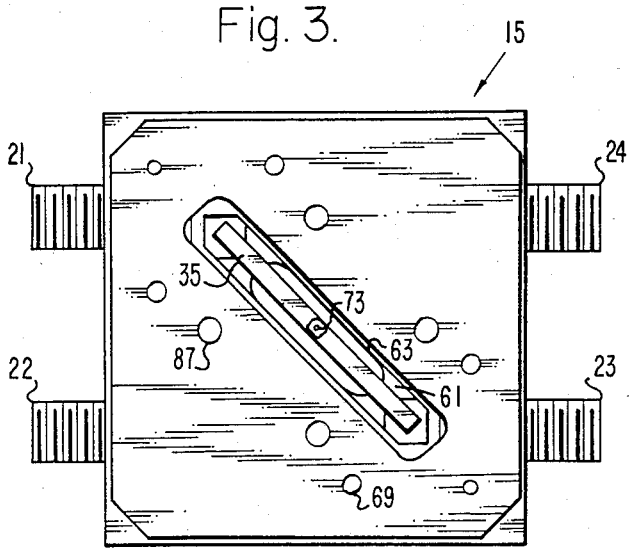
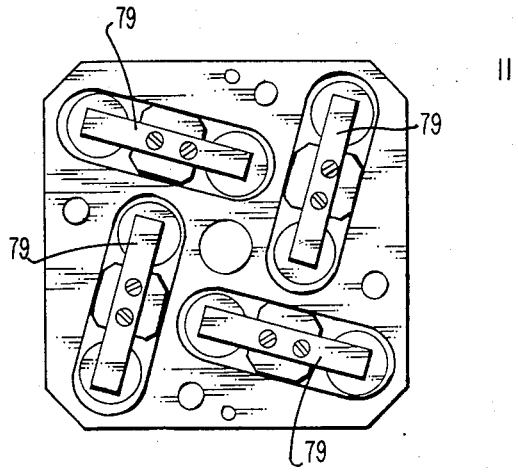
Fig. 4.

AIR-LINE MICROWAVE COAXIAL REVERSING SWITCH HAVING DIAGONALLY SWITCHED PATH

BACKGROUND OF THE INVENTION

The present invention relates to switches, and more particularly to a reversing switch for a microwave coaxial network.

Four-port reversing switches for microwave coaxial networks permit connections between any pair of ports, other than diagonally disposed ports. In certain applications, diagonal connections are also desired, for example, to provide redundancy in a satellite communications network. For example, the additional switch condition can allow a failed section of a network to be bypassed.

Both air-line and strip-line reversing switches are known. Air-line switches tend to be more reliable and less lossy than the alternative strip-line switches. More specifically, the dielectric of the strip-line switch is a source of power loss. Also, the strip-line devices are more sensitive to thermal variations, making it more difficult to match the switch to the incoming and outgoing transmission lines. Thus, performance is less reliable and predictable.

A switch for a redundant network is disclosed in U.S. Pat. No. 4,070,637 to Assal et al. However, this switch is a strip-line device and its configuration is not transferable to air-line switches where isolation of conductors requires distinct cavities. Furthermore, the large number of delicate mechanical connections suggest problems with fabrication and reliability.

What is needed is an air-line microwave coaxial switch which permits diagonal as well as lateral connection. Such a switch should be highly reliable for satellite applications and relatively simple to fabricate.

SUMMARY OF THE INVENTION

A switch of the type comprising a rectangular arrangement of terminals or ports includes a diagonally extending connector bar disposed on one side of the rectangular arrangement opposite four laterally extending connector bars. The diagonally disposed connector bar is actuatable independently of the other bars. Electromagnetically driven rockers or other means are provided to actuate the rods.

In one realization of the switch, the ports are coaxial connectors for a microwave network. Each connector bar resides within a corresponding groove in a conductive housing and is independently actuatable. When actuated, a bar contacts the center conductors of two ports. The actuated bar cooperates with the walls of the containing groove to form an air-line microwave connection between the contacted ports. When the contained bar is unactuated, the groove becomes a waveguide-beyond-cutoff to isolate the respective ports.

BRIEF DESCRIPTION OF THE DRAWINGS

FIG. 3 is a bottom plan view of an rf cavity unit component of the switch of FIG. 1 with a connecting bar installed.

FIG. 4 is a bottom plan view of a top clapper assembly of the switch of FIG. 1.

DESCRIPTION OF THE PREFERRED EMBODIMENTS

Figure 1:
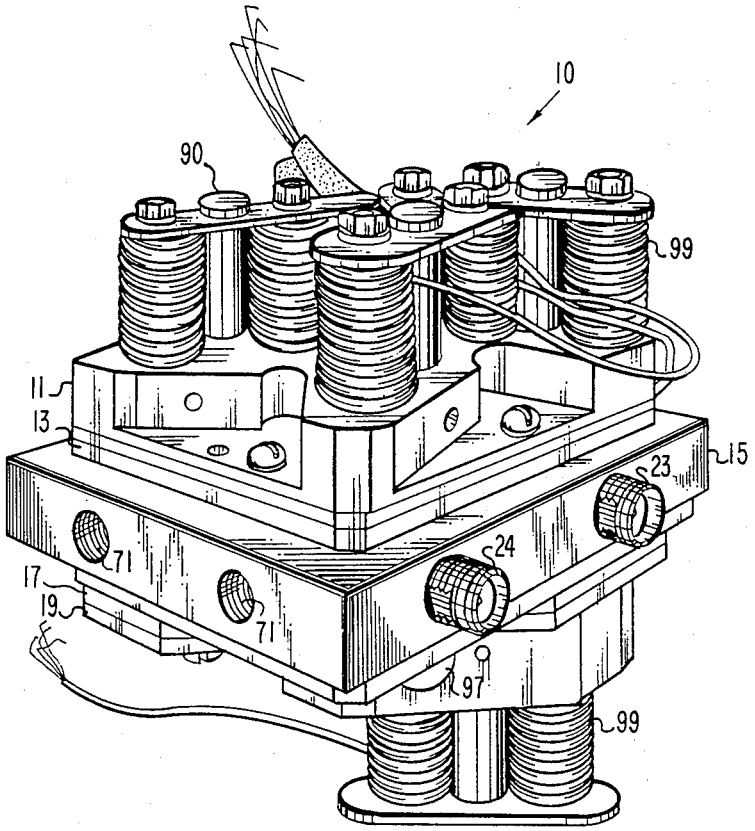
FIG. 1 is a perspective view of a switch in accordance with the present invention.
Figure 2:
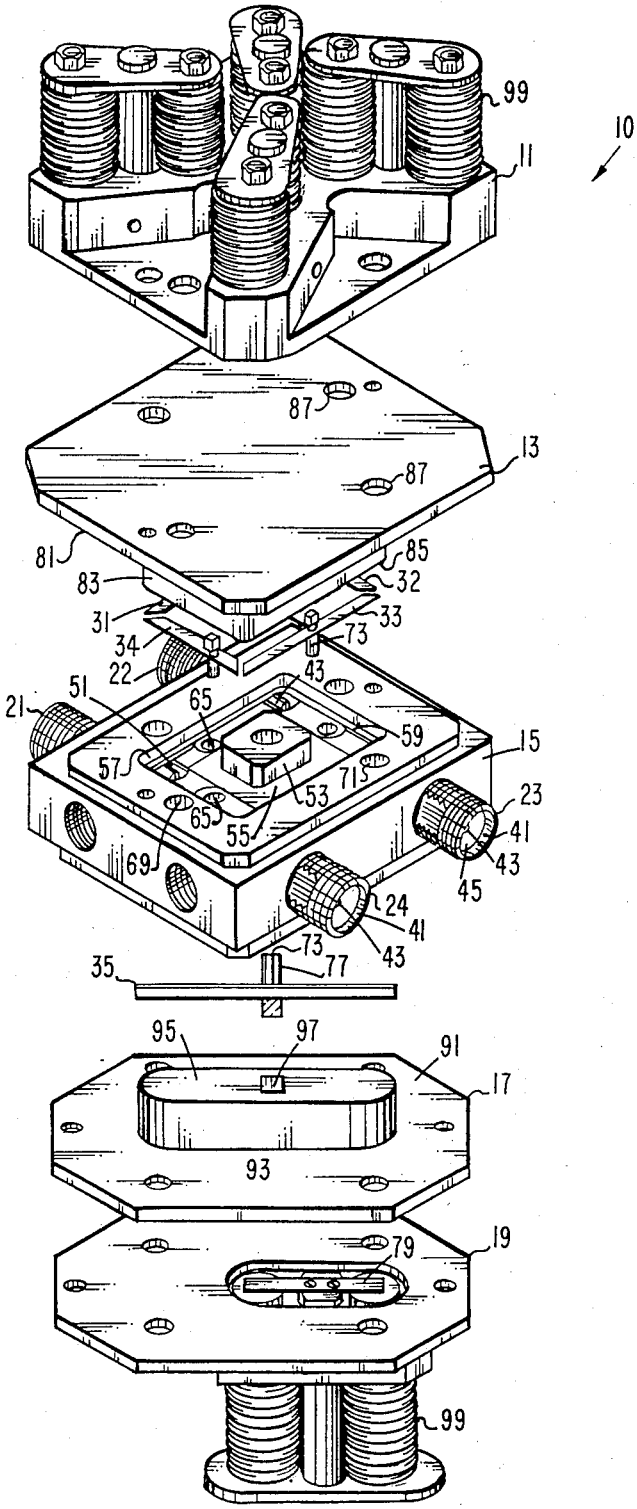
FIG. 2 is an exploded view of the switch of FIG. 1.

A reversing switch 10 includes a top clapper subassembly 11, a top cover 13, an rf cavity unit 15, a bottom cover 17 and a bottom clapper subassembly 19, as indicated in FIGS. 1 and 2. Attached to the rf cavity unit 15 are first, second, third and fourth terminals or ports, 21, 22, 23 and 24. First, second, third, fourth and fifth connector bars 31, 32, 33, 34 and 35 reside in the rf cavity unit 15. In accordance with the present invention, the fifth connector bar 35 is situated on the side of the rf cavity unit 15 opposite the first four connector bars 31, 32, 33 and 34 and permits electrical connection of the first and third ports 21 and 23.

Each port 21–24 includes an outer conductor 41 and a center conductor 43 separated by a dielectric spacer 45, as shown in FIG. 2. The center conductor 43 extends to the interior of the rf cavity unit 15 where it can be contacted by respective connecting bars. The rf cavity unit 15 is machined from conductive material, such as aluminum, and is physically and electrically connected to the outer conductors 41 of the ports to form a common ground. From the perspective of FIG. 2, the ports 21, 22, 23 and 24 are arranged clockwise, respectively, about the rf cavity unit 15. The first and second ports 21 and 22 are situated on a side opposite the side to which the third and fourth ports 23 and 24 are attached. The first and third ports 21 and 23 are situated diagonally, as are the second and fourth ports 22 and 24.

The rf cavity unit 15, which has a generally squar cross-section, includes a square groove 51 extending from the top of the rf cavity unit nearly half-way down, so as to communicate with the center conductors 43 of the ports. The inner dimension of the square groove 51 is defined by a beveled square mesa 53 and an adjacent square ledge 55. The outer dimension of the square groove 51 is defined by a square wall 57 with a ridge 59. The ledge 55 and ridge 59 cooperate to define a relatively narrow guide for the first four connector bars 31, 32, 33 and 34. The larger dimensions above the ledge 55 and ridge 59 permit precise assembly with the top cover 13.

Communicating with the first and third ports 21 and 23 and extending diagonally therebetween, the rf cavity unit 15 also includes an elongated groove 61 see FIG. 3. Extending from the bottom of the rf cavity unit 15 nearly half-way up, this elongated groove 61 see FIG. 3 includes a ridge 63 for precise alignment of the fifth connector bar 35 and precise assembly of the bottom cover 17.

The rf cavity unit 15 includes four holes 65 from above and one from below (hidden by peg 73 in FIG. 3) in which springs (not shown) are inserted. Each spring, in its extended position, serves to maintain a respective connector bar 31–35 in its unactuated position. Each spring can be compressed to permit the connector bar 31–35 to achieve its actuated position. The rf cavity unit 15, like the other major components, includes holes 69 for alignment and assembly bolts. Mounting holes 71, formed in the side of the rf cavity unit 15, provide for mounting the switch 10 to another structure.

Each connector bar 31–35 is a thin strip or reed of conductive material. The first four connector bars 31, 32, 33 and 34 are cooperatively shaped to allow each to independently and securely contact its respective ports. Accordingly, each of these four connector bars 31–34 is trapezoidal, with the parallel sides being much longer than the nonparallel sides. The nonparallel sides form 45° angles with the parallel sides. The fifth connector bar 35 has the form of an elongated rectangle. The connector bars 31–35 are designed to provide an electrical impedance of 50 ohms.

Extending through the center of each connector bar 31–35 is a peg 73. Each peg 73 is fitted with respective dielectric tubes 77. The tubes 77 help to maintain the positioning of the peg 73 through the connector bar. One end of each peg 73 is adapted for receiving a mechanical driving motion from a clapper 79 to actuate the respective connector bar. The other end of each peg 73 is adapted to engage a spring, situated in a respective spring hole 65, to de-actuate the respective connector bar when the force of the clapper 79 is removed.

The top cover 13 includes a flat portion 81 and a square raised portion 83 shaped to fit snuggly within the square groove 51 of the rf cavity unit 15 above the ledge 55 and ridge 59. When the switch 10 is assembled, the bottom-most surface 85 of the top cover 13 cooperates with the ledge 55, ridge 59 and base of the square groove 51 to define four cavities between non-diagonal pairs of ports. The top cover 13 includes four access holes 87 to permit respective pegs 73 to extend therethrough so as to be accessible to respective clappers 79.

The bottom cover 17 likewise includes a flat portion 91 and a raised portion 93. The top-most portion 95 of the bottom cover 17 cooperates with the ridge 63 and the base of the diagonal elongated groove 61 to define a cavity extending between the first and third ports 21 and 23. The bottom cover 17 includes an access hole 97 for the peg 73 connected to the fifth connector bar 35.

The clapper subassemblies 11 and 19 are designed to permit independent actuation of each of the connector bars 31–35 in response to external commands. In the illustrated embodiment, clappers 79 may be positioned "on" or "off" by electromagnets 99. Permanent magnets 90 may be used to maintain clapper positions between commands. As a clapper 79 is switched to its "on" position, one of its arms depresses a respective peg 73, driving a respective connector bar 31–35 to its actuated position. As a clapper 79 is switched to its "off position," the pressure on the peg 73 is released. The uncontacted peg is forced outward up by action of the respective spring so as to place the respective connector bar in its unactuated position.

In operation, a clapper 79 can be actuated by the presence of a magnetic field when a DC pulse (e.g., 28 volts) is applied to one of the two respective coils of each respective electromagnet 99. After actuation, a clapper 79 is held in position by a respective permanent magnet 90 until a command pulse is applied to the opposing coil. The movements in the clapper 79 are transferred to contact assemblies located in the rf cavity unit 15.

In its actuated position ("on"), a connector bar 31–35 provides a low loss rf transmission medium between associated ports. More specifically, the connector bar serves as a center conductor of a coaxial transmission line between the connected ports. The bulk of the rf cavity unit 15, including the walls of the respective cavity, serve as the outer conductor of the coaxial transmission line between the connected ports.

When in its actuated position ("off"), the connector bar is held against the corresponding cover 13, 17 serving as a cavity wall, by the respective spring. In this unactuated position, the cavity unit 15 becomes a waveguide with a cutoff frequency at 45 GHz. This condition provides high isolation in the design operating bandwidth of DC to 18.0 GHz. For each connector bar, the cross-section of the containing waveguide formed between the covers 13, 17 and the bottom of the grooves 51, 61 is about 0.131 inches wide and about 0.071 inches deep.

In normal usage, either the first and third connector bars 31, 33 would be actuated or the second and fourth connector bars 32 and 34 would be actuated. The fifth connector bar 35 would be actuated to bypass a defective component and redirect signals to a separate part of a switching network.

In accordance with the foregoing, an air-line microwave coaxial switch permits diagonal as well as lateral connection. The switch is highly reliable and relatively simple to fabricate, due in part to the relatively small number of mechanical parts/subassemblies required to effect actuation.

Those skilled in the art can ascertain that many modifications and variations are readily applicable to the invention. For example, higher frequency and rf power ranges may be accommodated by appropriate matching and scaling. Also, this design approach can be extended to include a variety of multiple-pole-multiple-throw switch configurations. These and other embodiments and variations thereon may be employed within the scope of the present invention.

What is claimed is:

1. An air-line RF switch comprising:

an RF cavity unit housing defining respective first and second adjacent RF cavities substantially disposed in respective first and second substantially parallel and spaced apart positions, the cavity unit housing having a square cross section, said first RF cavity having a plurality of RF cavity segments substantially in the first position, said first RF cavity, having a plurality of interconnecting grooves disposed therewithin, said second RF cavity, disposed substantially in the second position; the second cavity having a groove that is located in a substantially diagonal relationship to the interconnecting grooves of said first RF cavity;

first, second, third and fourth RF ports connected to the RF cavity housing, the first and second ports also located on one side of the RF cavity housing, the third and fourth ports located on an oppositely disposed side of the cavity housing, in relation to the first and second port, the first and the third ports being located in a first diagonal relationship with each other, the second and the fourth ports being located in a second diagonal relationship with each other, each of the ports comprising a center conductor disposed within an outer conductor, the outer conductor of each of the ports being connected to the cavity housing, the center conductors of said first, second, third and fourth ports extending to the interior of said first RF cavity, the center conductors of the first and third ports also extending to the interior of said second RF cavity, the center conductors of the first and third ports extending to the interior of the first RF cavity at substantially diagonally opposed portions of said first RF cavity and extending to the interior of the second cavity at substantially opposite ends thereof, the center conductors of said second and fourth ports extending to the interior of said first RF cavity at substantially different diagonally opposed portions of said first RF cavity, said first, second, third and fourth ports each being substantially equally spaced from adjacent ports about said first RF cavity;

actuable first, second, third and fourth RF transfer bars disposed within said first cavity, said first bar when actuated, electrically connecting the center conductors of said first and second RF ports, said second bar when actuated, electrically connecting the center conductors of said second and thrid RF ports, said third bar when actuated, electrically connecting the center conductors of said third and fourth RF ports, said fourth bar when actuated, electrically connecting the center conductors of said fourth and first RF ports;

an actuable fifth RF transfer bar disposed within said second cavity, said fifth RF transfer bar when actuated, diagonally electrically connecting the center conductors of said first and third RF ports; and actuation means for actuating said first, second, third, fourth and fifth RF transfer bars.

2. The switch of claim 1 wherein said RF cavity unit housing comprises electrically conductive material.

3. The switch of claim 1 wherein said first, second, third, fourth and fifth RF transfer bars respectively comprise substantially elongated strips of conductive material.

4. The switch of claim 1 wherein the respective first, second, third and fourth transfer bars each move substantially in a first direction to respectively move from an actuated to an unactuated position; and said fifth transfer bar moves substantially in a second direction to move from an actuated to an unactuated position.

5. The switch of claim 1 wherein said RF cavity unit housing comprises:

an RF cavity unit including a top section and a bottom section, said top section defining the plurality of interconnecting grooves in said first position, the interconnecting grooves having a substantially rectangular cross-section, each of the grooves having a connection point at a corner of the rectangular cross-section, said bottom section defining a substantially elongated bottom groove in said second position, the bottom groove being in a substantially diagonal position relative to opposing corners of said interconnecting groove;

a top cover enclosing said top groove to define said first cavity; and a bottom cover enclosing said substantially elongated bottom groove to define said second cavity.

6. The switch of claim 5 wherein:

the respective center conductors of the respective RF ports extend to the interior of said first cavity adjacent to respective connection points of the adjacent groove segments; and the center conductors of the first and third RF ports extend to the interior of said second cavity at substantially opposite ends of said elongated bottom groove adjacent to respective diagonally opposed connection points of adjacent groove segments.

7. The switch of claim 5 wherein said RF cavity unit has a substantially rectangular cross-section.

8. The switch of claim 1 wherein:

said first RF cavity defines a waveguide beyond cutoff when said first, second, third and fourth RF transfer bars are in an unactuated position; and said second RF cavity defines a waveguide beyond cutoff when said fifth RF transfer bar is in an unactuated position.

9. An air-line RF switch comprising;

an RF cavity unit including a top section and a bottom section, said top section defining a top groove, comprising four interconnecting groove segments substantially disposed in a first position of the RF cavity unit, each of the grooves having a segment or connection point at a corner of an interconnection, said bottom section defining a substantially elongated bottom groove substantially disposed in a second position which is substantially parallel to and spaced apart from the first position, said bottom groove disposed substantially diagonally to opposing corner of said interconnecting groove segments;

a top cover enclosing said top groove to define a first RF cavity;

a bottom cover enclosing said bottom groove to define a second RF cavity;

first, second, third and fourth RF ports connected to the RF cavity unit, the first and second ports located on one side section of the unit, the third and fourth ports located on an oppositely disposed side section of the unit in relation to the first and second ports, the first and third ports being in an diagonal relationship with each other, each of the ports comprising a center conductor disposed within an outer conductor, the center conductors of said first, second, third and fourth ports extending to the interior of said first RF cavity, the center conductors of the first and third ports also extending to the interior of said second RF cavity, the center conductors of the first and third ports extending to the interior of the first RF cavity at substantially diagonally opposed portions of said first RF cavity and extending to the interior of the second cavity at substantially opposite ends of said bottom groove, the center conductors of said second and fourth ports extending to the interior of said first RF cavity at substantially different diagonally opposed portions of said first RF cavity, said first, second, third and fourth ports each being substantially equally spaced from adjacent ports about said first RF cavity;

actuable first, second, third and fourth RF transfer bar disposed within said first cavity, said first bar when actuated, electrically connecting the center conductors of said first and second RF ports, said second bar when actuated electrically, connecting the center conductors of said second and third RF ports, said third bar when actuated electrically, connecting the center conductors of said third and fourth RF ports, said fourth bar when actuated electrically, connecting the center conductors of said fourth and first RF ports;

an actuable fifth RF transfer bar disposed within said second cavity, said fifth RF transfer bar, when actuated, diagonally electrically connecting the center conductors of said first and third RF ports; and actuation means for actuating said first, second, third, fourth and fifth RF transfer bars.

10. The switch of claim 9 wherein the respective first, second, third and fourth transfer bars each move substantially toward the top cover to respectively move from an actuated to an unactuated position; and said fifth transfer bar moves substantially toward the bottom cover to move from an actuated to an unactuated position.

* * * * *